US006985154B2

(12) United States Patent
Nakatsuka

(10) Patent No.: US 6,985,154 B2
(45) Date of Patent: Jan. 10, 2006

(54) IMAGE PROCESSING FOR DISPLAY OF OFF-SCREEN DATA

(75) Inventor: Tadanori Nakatsuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 188 days.

(21) Appl. No.: 10/409,191

(22) Filed: Apr. 9, 2003

(65) Prior Publication Data

US 2003/0197697 A1 Oct. 23, 2003

(30) Foreign Application Priority Data

Apr. 19, 2002 (JP) ..... 2002-117699

(51) Int. Cl.
*G09G 5/36* (2006.01)

(52) U.S. Cl. ..... 345/548; 345/547; 345/418; 382/173; 715/764; 715/781

(58) Field of Classification Search ..... 345/548, 345/418, 440, 545–547; 382/173; 715/764, 715/781

See application file for complete search history.

(56) References Cited

U.S. PATENT DOCUMENTS

| | | | | |
|---|---|---|---|---|
| 5,363,483 | A * | 11/1994 | Jones et al. | 345/766 |
| 5,859,646 | A * | 1/1999 | Takenaka | 345/619 |
| 5,999,207 | A * | 12/1999 | Rodriguez et al. | 348/14.03 |
| 6,104,832 | A | 8/2000 | Saito et al. | 382/176 |
| 6,385,338 | B1 | 5/2002 | Saito et al. | 382/173 |

* cited by examiner

*Primary Examiner*—Kee M. Tung
*Assistant Examiner*—Mackly Monestime
(74) *Attorney, Agent, or Firm*—Fitzpatrick, Cella, Harper & Scinto

(57) ABSTRACT

Conventionally, in displaying a document on a display, the document is displayed on the display after an image of the document is drawn off-screen once. Thus, it may take long until the image of the document can be checked when it is drawn for the first time. In an image processing apparatus of this invention, every time a predetermined number of drawing elements among drawing elements included in document data are developed off-screen, it is checked whether or not the developed off-screen drawing elements satisfy intermediate drawing conditions and, when it is determined that the intermediate drawing conditions are satisfied, the developed off-screen drawing elements are drawn on the display.

13 Claims, 6 Drawing Sheets

FIG. 3

| INTERMEDIATE DRAWING CONDITION |
|---|
| CONDITION 1: 50th LINE-DRAWING |
| CONDITION 2: LINE-DRAWING HAVING MORE THAN 1000 PIXELS WIDTH |
| CONDITION 3: LINE-DRAWING HAVING MORE THAN 1000 PIXELS HEIGHT |
| CONDITION 4: LINE-DRAWING HAVING MORE THAN 1000 PIXELS LENGTH |
| CONDITION 5: 5th IMAGE |
| CONDITION 6: IMAGE HAVING MORE THAN 200 PIXELS WIDTH |
| CONDITION 7: IMAGE HAVING MORE THAN 200 PIXELS HEIGHT |
| CONDITION 8: IMAGE HAVING MORE THAN 3000 DIMENSION |
| CONDITION 9: IMAGE HAVING MORE THAN 24 BIT/PIXEL |
| CONDITION 10: 3000th CHARACTER |
| CONDITION 11: CHARACTER HAVING MORE THAN 500 PIXELS WIDTH |
| CONDITION 12: CHARACTER HAVING MORE THAN 500 PIXELS HEIGHT |

FIG. 4

INTERMEDIATE DRAWING CONDITION

CONDITION 1: 50th LINE-DRAWING
CONDITION 2: LINE-DRAWING HAVING MORE THAN 1000 PIXELS WIDTH
CONDITION 3: LINE-DRAWING HAVING MORE THAN 1000 PIXELS HEIGHT
CONDITION 4: LINE-DRAWING HAVING MORE THAN 1000 PIXELS LENGTH
CONDITION 5: 5th IMAGE
CONDITION 6: IMAGE HAVING MORE THAN 200 PIXELS WIDTH
CONDITION 7: IMAGE HAVING MORE THAN 200 PIXELS HEIGHT
CONDITION 8: IMAGE HAVING MORE THAN 3000 DIMENSION
CONDITION 9: IMAGE HAVING MORE THAN 24 BIT/PIXEL
CONDITION 10: 3000th CHARACTER
CONDITION 11: CHARACTER HAVING MORE THAN 500 PIXELS WIDTH
CONDITION 12: CHARACTER HAVING MORE THAN 500 PIXELS HEIGHT

*THRESHOLD OF EACH CONDITION SHALL BE ADJUSTED BASED ON OS TYPE AS FOLLOWS

| | |
|---|---|
| Windows95: | 0.5 TIMES |
| Windows98: | 0.6 TIMES |
| WindowsME: | 0.7 TIMES |
| WindowsNT: | 0.8 TIMES |
| Windows2000: | 0.9 TIMES |
| WindowsXP: | 1.0 TIMES |

FIG. 5

| INTERMEDIATE DRAWING CONDITION |
|---|
| CONDITION 1: 50th LINE-DRAWING |
| CONDITION 2: LINE-DRAWING HAVING MORE THAN 1000 PIXELS WIDTH |
| CONDITION 3: LINE-DRAWING HAVING MORE THAN 1000 PIXELS HEIGHT |
| CONDITION 4: LINE-DRAWING HAVING MORE THAN 1000 PIXELS LENGTH |
| CONDITION 5: 5th IMAGE |
| CONDITION 6: IMAGE HAVING MORE THAN 200 PIXELS WIDTH |
| CONDITION 7: IMAGE HAVING MORE THAN 200 PIXELS HEIGHT |
| CONDITION 8: IMAGE HAVING MORE THAN 3000 DIMENSION |
| CONDITION 9: IMAGE HAVING MORE THAN 24 BIT/PIXEL |
| CONDITION 10: 3000th CHARACTER |
| CONDITION 11: CHARACTER HAVING MORE THAN 500 PIXELS WIDTH |
| CONDITION 12: CHARACTER HAVING MORE THAN 500 PIXELS HEIGHT |

*THRESHOLD OF EACH CONDITION SHALL BE ADJUSTED BASED ON CPU CLOCK AS FOLLOWS (THRESHOLD)=(ABOVE THRESHOLD)×(CPU CLOCK)÷(1GHz)

IMAGE PROCESSING FOR DISPLAY OF OFF-SCREEN DATA

BACKGROUND OF THE INVENTION

1. Field of the Invention

The present invention relates to image processing in displaying a document image.

2. Related Background Art

Conventionally, in display control for displaying documents prepared by various applications on a screen, in the case where scroll of a displayed part on a screen or redrawing of a part hidden behind another window is performed, off-screen images (images prepared by developing drawing elements off-screen (on a virtual screen), are stored in an internal memory (off-screen buffer for storing off-screen data) in order to perform drawing quickly.

However, in the conventional system, since no off-screen image is stored in the internal memory (off-screen buffer) when drawing is performed for the first time, an overall off-screen image is created first and then transferred onto the screen (on-screen) to perform drawing. Thus, there is a problem in that, for example, a user cannot check the image until the overall off-screen image is created, and particularly when working on a document requiring longer time for drawing, the user becomes displeased and wonders if the application has become hung-up or frozen.

SUMMARY OF THE INVENTION

In order to solve the above-mentioned problem, an image processing apparatus according to an aspect of the present invention includes:

off-screen development means for developing drawing elements included in document data off-screen;

display drawing means for performing control to draw a developed off-screen drawing element on a display; and intermediate drawing check means for, every time a predetermined number of drawing elements among the drawing elements are developed by the off-screen development means, checking whether or not the developed off-screen drawing elements satisfy predetermined intermediate drawing conditions and, when it is determined that the predetermined intermediate drawing conditions are satisfied, controlling the display drawing means to draw the developed off-screen drawing elements on the display.

In order to solve the above-mentioned problem, an image processing method according to another aspect of the present invention includes:

an off-screen development step of developing drawing elements included in document data off-screen;

display drawing steps which performs control to draw a developed off-screen drawing element on a display; and an intermediate drawing check step of, every time a predetermined number of drawing elements among the drawing elements are developed by the off-screen development step, checking whether or not the developed off-screen drawing elements satisfy predetermined intermediate drawing conditions and, when it is determined that the predetermined intermediate drawing conditions are satisfied, controlling the display drawing step to draw the developed off-screen drawing elements on the display.

In order to solve the above-mentioned problem, according to another aspect of the present invention, a computer program executable by a computer for processing an image in an information processing apparatus includes a problem code for causing the computer to execute:

an off-screen development step of developing drawing elements included in document data off-screen;

a display drawing step of performing control to draw the developed off-screen drawing element on a display; and an intermediate drawing check step of, every time a predetermined number of drawing elements among the drawing elements are developed by the off-screen development step, checking whether or not the developed off-screen drawing elements satisfy predetermined intermediate drawing conditions and, when it is determined that the predetermined intermediate drawing conditions are satisfied, controlling the display drawing step to draw the developed off-screen drawing elements on the display.

Other features and advantages of the patent invention will be apparent from the following description taken in conjunction with the accompanying drawings, in which like reference characters designate the same or similar parts throughout the figure thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 shows intermediate drawing conditions in a first embodiment;

FIG. 4 shows intermediate drawing conditions in a second embodiment;

FIG. 5 shows intermediate drawing conditions in a third embodiment; and

DESCRIPTION OF THE PREFERRED EMBODIMENTS

Figure 1:
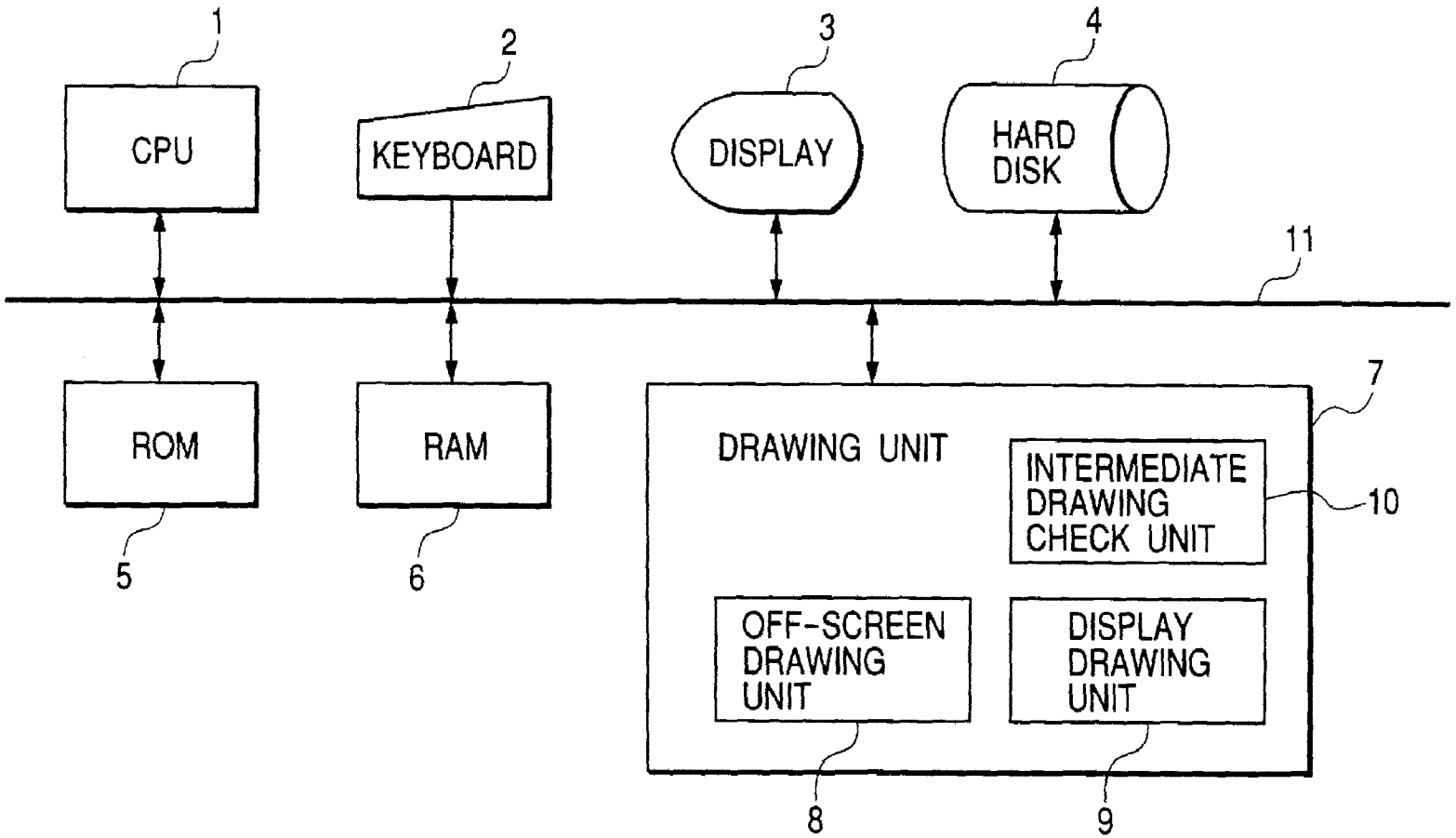
FIG. 1 is a block diagram of an image processing apparatus.

FIG. 1 shows an image processing apparatus in an embodiment mode of the present invention.

In the figure, reference numeral 1 denotes a CPU which executes a program for controlling this apparatus; 2, a keyboard for data input; 3, a display on which a document image is displayed; 4, a hard disk which stores a document; 5, a ROM which stores the program for controlling the apparatus and necessary information in advance; and 6, a RAM which is utilized as various work areas, in which an off-screen buffer for storing an image drawn off-screen (on a virtual screen) is assumed to be secured. Reference numeral 7 denotes a drawing unit which draws a document image off-screen or on the display 3 (on-screen), and 11 denotes a data bus which transfers various kinds of data. The drawing unit 7 includes: an off-screen drawing unit 8 which develops (draws) drawing elements in a document off-screen one by one; a display drawing unit 9 which draws contents developed (drawn) off-screen on the display 3; and an intermediate drawing check unit 10 which checks whether or not the contents which have already been developed (drawn) off-screen by the off-screen drawing unit 8 are developed (drawn) on the display by the display drawing unit 9.

Note that, the image processing apparatus of this embodiment mode is assumed to be realized by a program running on a computer. However, the computer may be constituted by one device or may be constituted by a plurality of devices. In addition, in this embodiment mode, a control program corresponding to a flowchart to be described later is assumed to be stored in a ROM. However, the control program may be stored in another internal storage medium such as a hard disk, or may be stored in an external storage medium such as a floppy (R) disk or a CD-ROM and read and executed if necessary, or may be received from an external device via a network and executed.

First Embodiment

Figure 2:
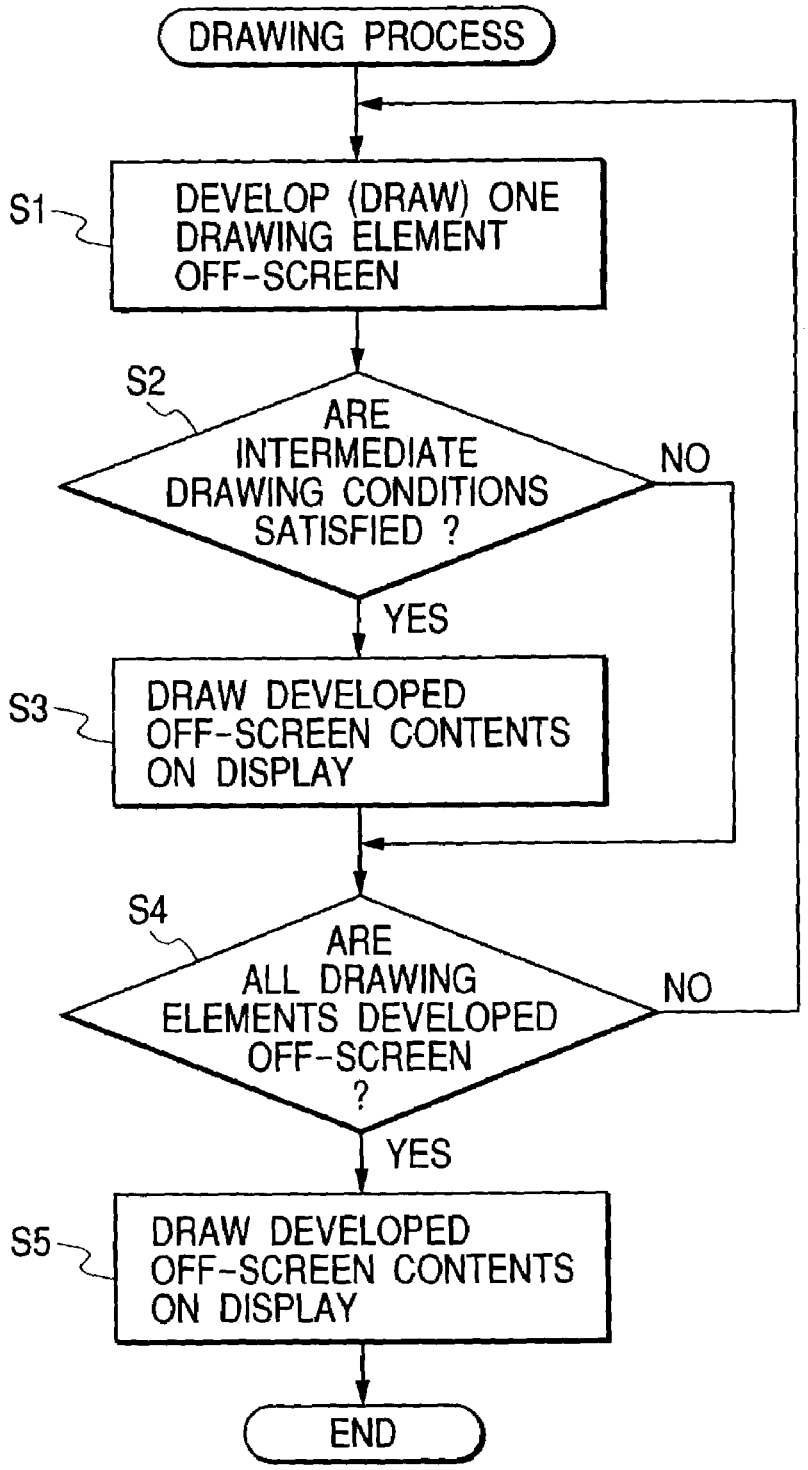
FIG. 2 is a flowchart showing image processing of the present invention.

FIG. 2 is a flowchart showing image processing performed by the image processing apparatus.

The CPU 1 executes a control program stored in the ROM 5, which corresponds to the flowchart of FIG. 2, thereby performing control to draw a document image in the hard disk 4 on the display 3.

In step S1, a document to be developed is read from the hard disk 4, and one of drawing elements of the document is developed (drawn) off-screen by the off-screen drawing unit 8 in the drawing unit 7. Note that the drawing element is a character, a line-drawing, an image, or the like included in a document.

In step S2, the CPU 1 controls the intermediate drawing check unit 10 to check whether or not the drawing element drawn off-screen in step S1 satisfies intermediate drawing conditions.

As shown in FIG. 3, conditions described below are used as examples of the intermediate drawing conditions.

Condition 1: 50th line-drawing

Condition 2: Line-drawing having more than 1000 pixels width.

Condition 3: Line-drawing having more than 1000 pixels height

Condition 4: Line-drawing having more than 1000 pixels length

Condition 5: 5th image

Condition 6: Image having more than 200 pixels width

Condition 7: Image having more than 200 pixels height

Condition 8: Image having more than 3000 dimensions

Condition 9: Image having more than 24 bit/pixel

Condition 10: 3000th character

Condition 11: Character having more than 500 pixels width

Condition 12: Character having more than 500 pixels height

If at least one condition among these conditions is satisfied, the image processing proceeds to step S3. If no condition is satisfied, the image processing proceeds to step S4.

In step S3, the CPU 1 controls the display drawing unit 9 to draw contents, which have been developed (drawn) off-screen to that point, on the display 3. Thus, a user can check the drawn contents which have been processed to that point.

Next, in step S4, again, the CPU 1 controls the intermediate drawing check unit 10 to check if all the drawing elements included in the document to be developed have been developed (drawn) off-screen. If all the drawing elements have been developed (YES in S4), the image processing proceeds to step S5. If all the drawing elements have not been developed (NO in S4), the image processing returns to step S1, and the next one of the drawing elements is developed (drawn) off-screen.

In step S5, the CPU 1 transfers an off-screen image, which is created by developing all the drawing elements off-screen, to the display 3 (on-screen) and draws an image thereon.

As described above, according to this embodiment, a comfortable image processing apparatus can be provided with which, even in the case where there are a large number of drawn contents and image processing takes long time, an intermediate state is indicated to a user, thereby enabling the user to check a document quickly and reduce displeasure of the user.

In addition, by setting the intermediate drawing conditions properly, intermediate drawing can be performed at appropriate timing.

Second Embodiment

A second embodiment of the present invention will be described.

FIG. 4 shows another example of the intermediate drawing conditions used by the intermediate drawing check unit 10 in step S2 of FIG. 2. In this example, the check in step S2 is performed after adjusting a threshold value of each condition as described below based on a type of an OS for operating the image processing apparatus.

As shown in FIG. 4, conditions described below are used as the intermediate drawing conditions. Note that the check is performed after adjusting the conditions as described below for each OS as shown in FIG. 4. Note that the Windows (registered trademark) series of Microsoft Corporation are used as examples of the OS in this embodiment.

Condition 1: 50th line-drawing

Condition 2: Line-drawing having more than 1000 pixels width.

Condition 3: Line-drawing having more than 1000 pixels height

Condition 4: Line-drawing having more than 1000 pixels length

Condition 5: 5th image

Condition 6: Image having more than 200 pixels width

Condition 7: Image having more than 200 pixels height

Condition 8: Image having more than 3000 dimensions

Condition 9: Image having more than 24 bit/pixel

Condition 10: 3000th character

Condition 11: Character having more than 500 pixels width

Condition 12: Character having more than 500 pixels height

Threshold of each condition shall be adjusted based on OS type as follows.

| | |
|---|---|
| Windows (registered trademark) 95: | 0.5 times |
| Windows (registered trademark) 98: | 0.6 times |
| Windows (registered trademark) ME: | 0.7 times |
| Windows (registered trademark) NT: | 0.8 times |
| Windows (registered trademark) 2000: | 0.9 times |
| Windows (registered trademark) XP: | 1.0 times |

When the above-mentioned conditions are used, for example, in the case where the OS is Windows (registered trademark) 95, a threshold value 50 of the condition 1 is adjusted as 50×0.5=25. If the line-drawing has been performed for the 25th time, the CPU 1 checks that the condition 1 is satisfied and the image processing proceeds to step S3. The determines is also performed for the other OSs and the other conditions after the threshold values are adjusted in the same manner.

As described above, in the second embodiment, the same effect as in the first embodiment can be obtained and, at the same time, meticulous image processing control according to a processing capability of an OS can be performed.

Third Embodiment

A third embodiment of the present invention will be described.

FIG. 5 shows another example of the intermediate drawing conditions used by the intermediate drawing check unit 10 in step S2 of FIG. 2. In this example, the check in step S2 is performed after adjusting a threshold value of each condition as described below based on its CPU operating clock.

As shown in FIG. 5, conditions described below are used as the intermediate drawing conditions.

Condition 1: 50th line-drawing

Condition 2: Line-drawing having more than 1000 pixels width.

Condition 3: Line-drawing having more than 1000 pixels height

Condition 4: Line-drawing having more than 1000 pixels length

Condition 5: 5th image

Condition 6: Image having more than 200 pixels width

Condition 7: Image having more than 200 pixels height

Condition 8: Image having more than 3000 dimensions

Condition 9: Image having more than 24 bit/pixel

Condition 10: 3000th character

Condition 11: Character having more than 500 pixels width

Condition 12: Character having more than 500 pixels height

Threshold of each condition shall be adjusted based on CPU clock as follows.

$$(\text{Threshold})=(\text{above threshold})\times(\text{CPU clock})/(1\ \text{GHz})$$

When the above-mentioned conditions are used, for example, in the case where the CPU clock is 0.8 GHz, a threshold value of the condition 1 being 50 is adjusted as $50\times0.8/1=40$. If the line-drawing has been performed for the 40th time, the CPU 1 determines that the condition 1 is satisfied and the image processing proceeds to step S3. The check is also performed for the other clock and the other conditions after the thresholds are adjusted in the same manner.

As described above, in the third embodiment, the same effect as in the first embodiment can be obtained and, at the same time, meticulous image processing control according to a processing capability of a CPU can be performed.

Fourth Embodiment

Figure 6:
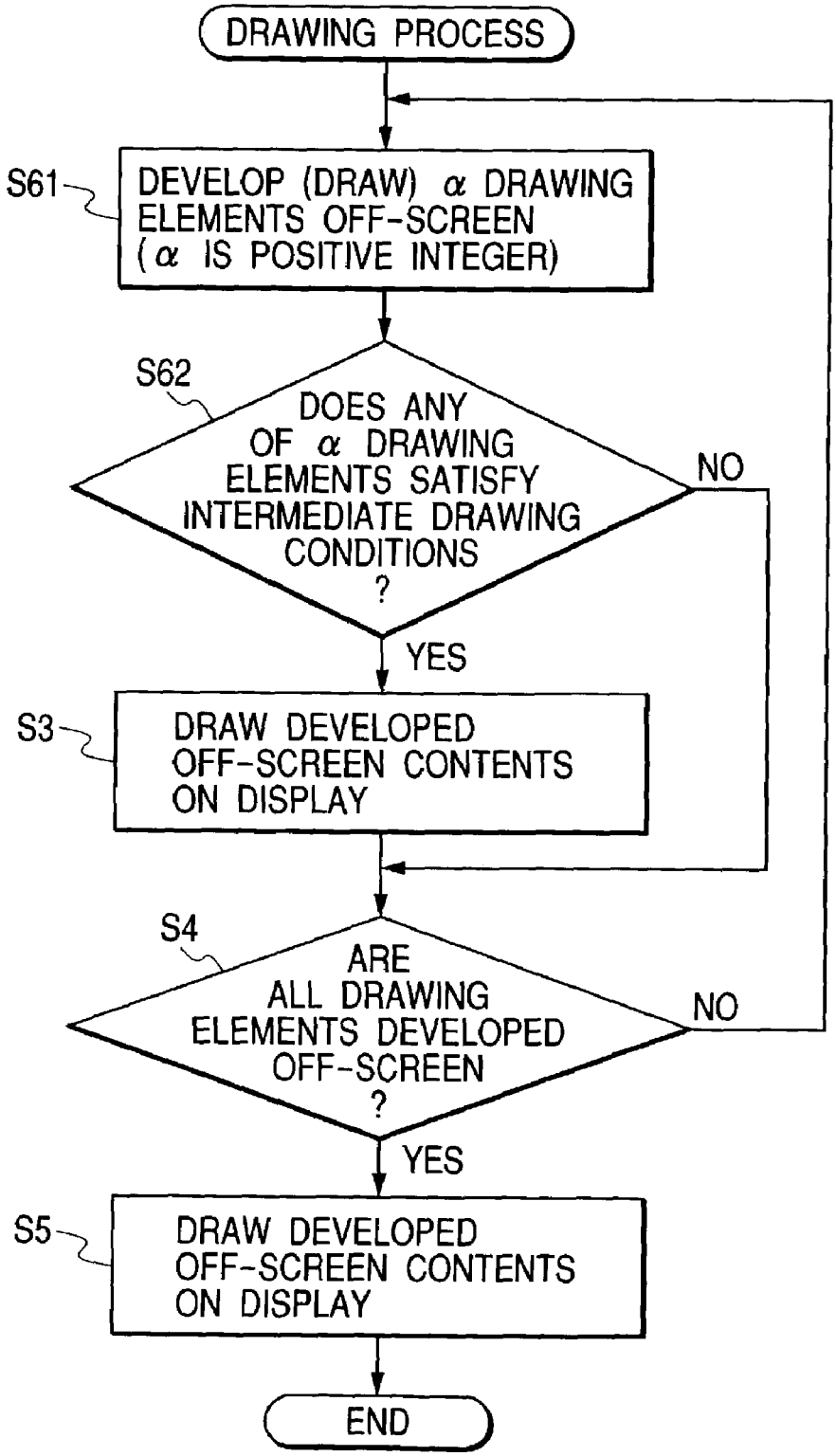
FIG. 6 is a flowchart showing image processing in a fourth embodiment.

FIG. 6 is a flowchart showing an image processing procedure of a fourth embodiment, which is another example of the image processing of FIG. 2. In the first embodiment, the check in step S2 is performed every time one drawing element is developed off-screen. However, in the fourth embodiment, check in step S62 is performed every time drawing elements of a predetermined number $\alpha$ are developed off-screen.

In step S6 of FIG. 6, a document to be developed is read from the hard disk 4, and $\alpha$ drawing elements of the document is developed (drawn) off-screen by the off-screen drawing unit 8 in the drawing unit 7. Note that $\alpha$ is a positive integer set in advance.

In step S62, in the intermediate drawing check unit 10, it is checked whether or not any one of the drawing elements, drawn off-screen in step S61 satisfies intermediate drawing conditions. As shown in FIG. 3, conditions described below are used as the intermediate drawing conditions.

Condition 1: 50th line-drawing

Condition 2: Line-drawing having more than 1000 pixels width.

Condition 3: Line-drawing having more than 1000 pixels height

Condition 4: Line-drawing having more than 1000 pixels length

Condition 5: 5th image

Condition 6: Image having more than 200 pixels width

Condition 7: Image having more than 200 pixels height

Condition 8: Image having more than 3000 dimensions

Condition 9: Image having more than 24 bit/pixel

Condition 10: 3000th character

Condition 11: Character having more than 500 pixels width

Condition 12: Character having more than 500 pixels height

If at least one condition among these conditions is satisfied, the image processing proceeds to step S3. If no condition is satisfied, the image processing proceeds to step S4. The subsequent processing is the same as in the first embodiment, so that its description will be omitted.

As described above, according to the fourth embodiment, a comfortable image processing apparatus can be provided with which, even in the case where there are a large number of drawn contents and image processing takes long time, an intermediate state is indicated to a user, thereby enabling the user to check a document quickly and reduce displeasure of the user.

Fifth Embodiment

In the above-mentioned embodiments, the CPU 1 controls the intermediate drawing check unit 10 to check whether or not at least one of the intermediate drawing conditions is satisfied. However, the check may be performed based on whether or not a plurality of conditions set in advance among the intermediate drawing conditions are satisfied.

For example, if a drawing element, which has been developed (drawn) off-screen to that point, satisfies two or more conditions among the intermediate drawing conditions, the image processing proceeds to step S3. In that case, for example, if only the condition 1 is satisfied, the image processing proceeds to step S4 and returns to step S1. If another condition, for example, the condition 7 is also satisfied, the image processing proceeds to step S3, and developed (drawn) off-screen contents are drawn on the display.

As described above in the first to fifth embodiments, according to the present invention, even in the case where there are a large number of drawn contents and image processing takes long time, an intermediate state is indicated to a user, thereby enabling the user to check a document quickly and reduce displeasure of the user. Also, it becomes less likely that the user wonders if hung-up of an application has occurred.

What is claimed is:

1. An image processing apparatus comprising:

off-screen development means for developing drawing elements of document data in an off-screen;

display drawing means for performing control to draw the drawing elements developed in the off-screen on a display; and intermediate drawing check means for, every time a predetermined number of drawing elements among the drawing elements are developed in the off-screen by said off-screen development means, checking whether or not the drawing elements developed in the off-screen satisfy predetermined intermediate drawing conditions and, when it is determined that the predetermined intermediate drawing conditions are satisfied, controlling said display drawing means to draw the drawing elements developed in the off-screen on the display.

2. An image processing apparatus according to claim 1, wherein, if it is determined that all drawing elements of the document data are developed in the off-screen, said intermediate drawing check means controls said display drawing means to draw the drawing elements developed in the off-screen on the display.

3. An image processing apparatus according to claim 1, wherein the intermediate drawing conditions are conditions which are set using at least one of a number of times of appearance, a length, and a size of a drawing element, the drawing element being a character, a line-drawing, or an image.

4. An image processing apparatus according to claim 1, wherein the intermediate drawing conditions are adjusted based on at least one of an OS of the image processing apparatus and CPU clock of the image processing apparatus.

5. An image processing method comprising:

an off-screen development step of developing drawing elements of a document data in an off-screen;

a display drawing step of performing control to draw the drawing elements developed in the off-screen on a display; and an intermediate drawing check step of, every time a predetermined number of drawing elements among the drawing elements are developed in the off-screen at said off-screen development step, checking whether or not the drawing elements developed in the off-screen satisfy predetermined intermediate drawing conditions and, when it is determined that the predetermined intermediate drawing conditions are satisfied, controlling execution of said display drawing step to draw the drawing elements developed in the off-screen on the display.

6. An image processing method according to claim 5, wherein, if it is determined that all drawing elements of the document data are developed off-screen, said intermediate drawing check step includes controlling execution of said display drawing step to draw the drawing elements developed in the off-screen on the display.

7. An image processing method according to claim 5, wherein the intermediate drawing conditions are conditions which are set using at least one of a number of times of appearance, a length, and a size of a drawing element, the drawing element being a character, a line-drawing, or an image.

8. An image processing method according to claim 5, wherein the intermediate drawing conditions are adjusted based on at least one of an OS in the image processing method and CPU clock in the image processing method.

9. A computer program executable by a computer for processing an image in an information processing apparatus, comprising a program code causing the computer to execute:

an off-screen development step of developing drawing elements of document data in an off-screen;

a display drawing step of performing control to draw the drawing elements developed in the off-screen on a display; and an intermediate drawing check step of, every time a predetermined number of drawing elements among the drawing elements are developed in the off-screen at said off-screen development step, checking whether or not the drawing elements developed off-screen satisfy predetermined intermediate drawing conditions and, when it is determined that the predetermined intermediate drawing conditions are satisfied, controlling execution of said display drawing step to draw the drawing elements developed in the off-screen on the display.

10. A computer program according to claim 9, wherein, if it is determined that all drawing elements of the document data are developed off-screen, said intermediate drawing check step includes controlling execution of said display drawing means to draw the drawing elements developed in the off-screen on the display.

11. A computer program according to claim 9, wherein the intermediate drawing conditions are conditions which are set using at least one of a number of times of appearance, a length, and a size of a drawing element, the drawing element being a character, a line-drawing, or an image.

12. A computer program according to claim 9, wherein the intermediate drawing conditions are adjusted based on at least one of an OS in the image processing method and CPU clock in the image processing method.

13. A storage medium which stores a computer program executable by a computer for processing an image in an image processing apparatus, the computer program comprising a program code for causing the computer to execute:

an off-screen development step of developing drawing elements of document data in an off-screen;

a display drawing step of performing control to draw the drawing elements developed in the off-screen on a display; and an intermediate drawing check step of, every time a predetermined number of drawing elements among the drawing elements are developed in the off-screen at said off-screen development step, checking whether or not the drawing elements developed in the off-screen drawing elements satisfy predetermined intermediate drawing conditions and, when it is determined that the predetermined intermediate drawing conditions are satisfied, controlling execution of said display drawing step to draw the drawing elements developed in the off-screen on the display.

* * * * *

UNITED STATES PATENT AND TRADEMARK OFFICE

CERTIFICATE OF CORRECTION

PATENT NO. : 6,985,154 B2
APPLICATION NO. : 10/409191
DATED : January 10, 2006
INVENTOR(S) : Tadanori Nakatsuka It is certified that error appears in the above-identified patent and that said Letters Patent is hereby corrected as shown below:

COLUMN 4:

Line 2, “long” should read --a long--.

COLUMN 6:

Line 26, “long” should read --a long--.
Line 50, “long” should read --a long--.

Signed and Sealed this

Twenty-first Day of November, 2006

JON W. DUDAS
*Director of the United States Patent and Trademark Office*